United States Patent [19]

Daly, Jr.

[11] Patent Number: 4,608,856

[45] Date of Patent: Sep. 2, 1986

[54] DOUBLE FEED DETECTION DEVICE

[75] Inventor: John Daly, Jr., Smyrna, Ga.

[73] Assignee: John L. Williams, Atlanta, Ga.

[21] Appl. No.: 493,522

[22] Filed: May 11, 1983

[51] Int. Cl.[4] ..... B65H 7/04

[52] U.S. Cl. ..... 73/37.7; 271/260

[58] Field of Search ..... 73/37.7, 37.6; 271/260, 271/262

[56] References Cited

U.S. PATENT DOCUMENTS

| | | | |
|---|---|---|---|
| 2,994,528 | 8/1961 | Hull et al. | 271/260 |
| 3,589,714 | 6/1971 | Staples et al. | 73/37.7 X |
| 3,826,487 | 7/1974 | Förster et al. | 73/37.7 X |

*Primary Examiner*—Stewart J. Levy

*Assistant Examiner*—Joseph W. Roskos

*Attorney, Agent, or Firm*—B. J. Powell

[57] ABSTRACT

A double feed detector to detect the feeding of multiple sheets into processing equipment such as printing presses which includes a reciprocally mounted gauge tube with a passage opening onto its opposite ends so that one of its ends is lowered into a gauging position over a support surface on which the sheets being fed are located. A pressurized air supply is connected to the gauge tube intermediate its ends and a cap closes that end of the passage opposite the end at the support surface so that, when more than one sheet is located on the support surface, the rise in air pressure in the gauge tube will urge the cap against a switch to stop the sheet feed to the processing equipment.

4 Claims, 7 Drawing Figures

DOUBLE FEED DETECTION DEVICE

BACKGROUND OF THE INVENTION

This invention relates generally to detection systems and more particularly to a double feed detection system for printing and packaging machinery.

It is frequently necessary to determine if more than one sheet of substrate is being fed at one time to processing equipment in the printing and packaging industries since feeding of more than one sheet of the substrate to the processing equipment at the same time can result in equipment damage. In the past, detection systems to detect whether multiple sheets of substrate are being fed to printing or packaging machinery typically relied on a direct contact mechanism such as a roller which was in turn connected through appropriate linkages to a disabling device which disabled the downstream machinery for printing or processing the substrate. Thus, the machinery was stopped when more than one sheet of substrate was being fed so that the additional sheet could be removed before being fed through the machinery to prevent damage thereto. While this type of detector works reasonably well on relatively thick substrates, it is very difficult to get the necessary accuracy for use on thin substrates. Further, the mechanical linkages of the prior art type detectors become worn during use and drastically affect the detection accuracy of the device.

SUMMARY OF THE INVENTION

These and other problems and disadvantages associated with the prior art are overcome by the invention disclosed herein by the provision of a detection device which has sufficient accuracy to detect very thin substrates when being fed to processing or printing equipment and has no mechanical linkages that affect the accuracy of the detection device once the device is used for an extended period of time. Further, the speed at which the device operates is sufficiently fast for the unit to operate close to the downstream processing equipment without causing damage to such equipment.

The apparatus of the invention includes generally a support which is mounted on the feeding mechanism of the packaging or printing equipment and which reciprocally mounts a gauge tube so that the gauge tube is reciprocally movable toward and away from a support surface over which the substrate must pass as it moves toward the downstream processing or printing equipment. The gauge tube is provided with a passage which opens onto opposite ends of the tube and which is provided with an inlet thereto intermediate its ends so that fluid under pressure can be injected into the passage through the inlet and pass out through the opposite ends of the tube. One end of the tube is positioned so that it is adjacent the surface over which the substrate must pass as it passes to the processing equipment while the opposite end of the tube is provided with a movable indicator body which provides an indication of the feeding of multiple substrates thereby. In other words, when two pieces of substrate are on the supporting surface under the end of the gauge tube, the fluid pressure inside the passage in the gauge tube will increase due to the reduced clearance between the end of the gauge tube and the substrate thus causing the indicator body to be lifted against the forces urging the body downwardly. This lifting of the indicator body serves to cause the machine stop mechanism to stop the operation of the downstream machinery until the multiple feed has been cleared.

These and other features and advantages of the invention will become more clearly understood upon consideration of the following detailed description and accompanying drawings wherein like characters of reference designate corresponding parts throughout the several views and in which:

These figures and the following detailed description disclose specific embodiments of the invention; however, it is to be understood that the inventive concept is not limited thereto since it may be embodied in other forms.

DETAILED DESCRIPTION OF ILLUSTRATIVE EMBODIMENTS

Figure 1:
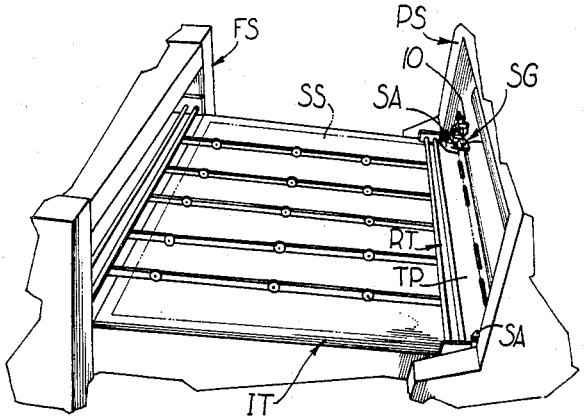
FIG. 1 is a perspective view illustrating a typical installation incorporating the invention.

A typical installation of the invention is illustrated in FIG. 1 which partially shows a large sheet fed printing press of the type manufactured in the past by the Miehle Company of Chicago, Ill. This printing press has a feeder section FS which individually feeds the substrate sheets SS across an infeed table IT to a register table mechanism RT. The register table mechanism RT serves to register the substrate sheet SS just prior to being fed into the press section PS of the equipment. The leading edge LE of the substrate sheet SS is registered with an appropriate registration mechanism in the register table mechanism RT while the side-to-side registration of the substrate sheet SS is controlled with a side guide mechanism SG. The construction of the various parts of this type of press is well known. The installation of the invention that is illustrated shows the detector unit 10 mounted on one of the side guide assemblies SA in the side guide mechanism SG as will become more apparent.

Figure 2:
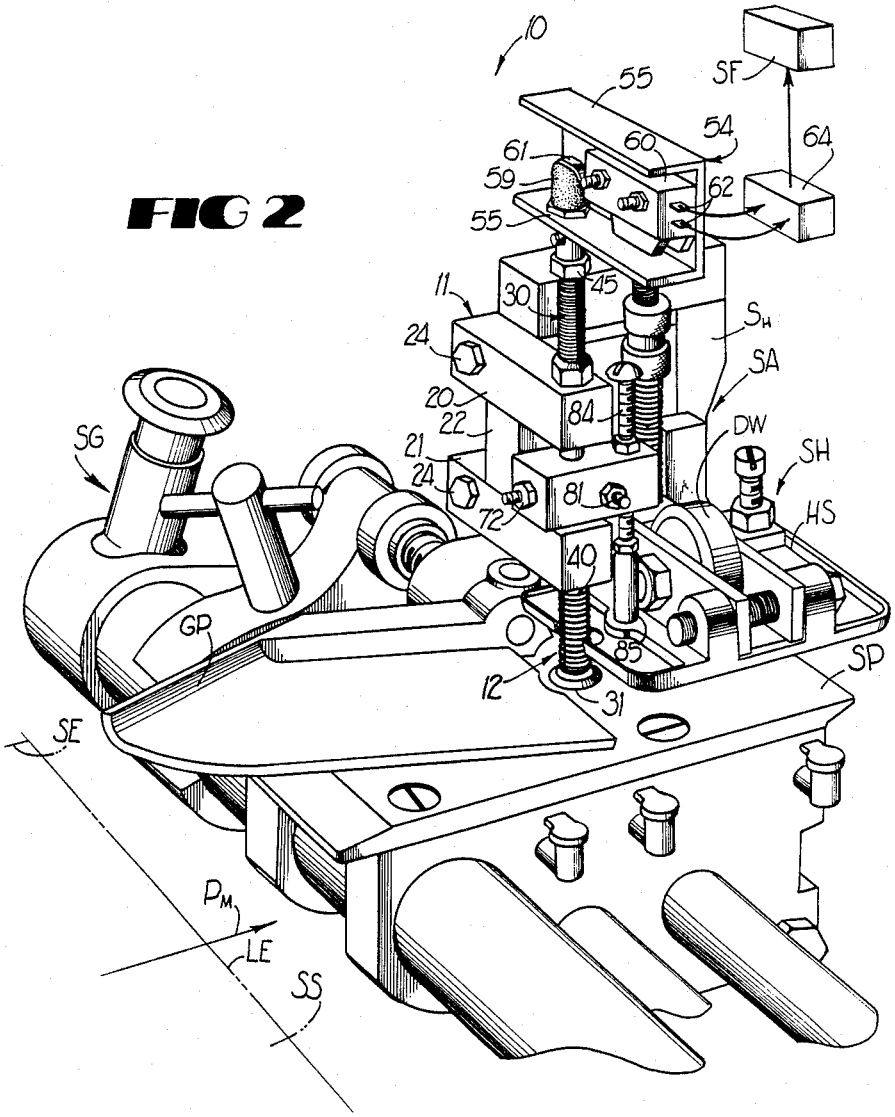
FIG. 2 is an enlarged perspective view illustrating the invention installed as shown in FIG. 1.

Turning now more specifically to FIG. 2, one of the side guide assemblies SA of the side guide mechanism SG is illustrated in greater detail. The side guide assembly SA includes a support plate SP over which each substrate sheet SS passes. The leading edge LE of the substrate sheet SS moves across the register table plate TP seen in FIG. 1 where it is arrested by the leading edge guides in the register table mechanism RT. The side edges SE of the substrate sheet SS pass just inboard of the outer edge of the support plate SP on the side guide assembly SA. A guide plate GP extends angularly upward from the support plate SP so that the substrate SS can pass between the underside of the guide plate GP and over the support plate SP.

The side guide assembly SA is also provided with a reciprocally movable shoe assembly SH which has a hold down shoe HS that is vertically reciprocated away from and toward the support plate SP. The shoe assembly SH mounts drive wheel DW which can drive the substrate sheet SS in a direction normal to the path of movement $P_M$ of the substrate sheet SS when the hold down shoe SH is lowered toward the support plate SP until the drive wheel DW comes in contact with the substrate sheet. In other words, it will be seen that the register table mechanism RT first engages the leading edge LE of the substrate sheet SS to stop its movement along the path PM and then the drive wheel DW is lowered into contact with the substrate sheet SS to drive the sheet SS further into or out of the side guide assembly SA along a path normal to the path $P_M$. All of this construction is well known. This action serves to register the substrate sheet SS both longitudinally and transversely before it is fed to the press section PS.

The detector unit 10 is mounted on the side of the shoe support $S_H$ so that it projects out over the edge of the substrate sheet SS when it is in registration in the register table mechanism RT. The detector unit 10 includes a support frame 11 which reciprocally mounts a gauge tube assembly 12. The gauge tube assembly 12 is operatively connected to the reciprocating hold down shoe HS on the side guide assembly SA via a drive assembly 14.

Figure 3:
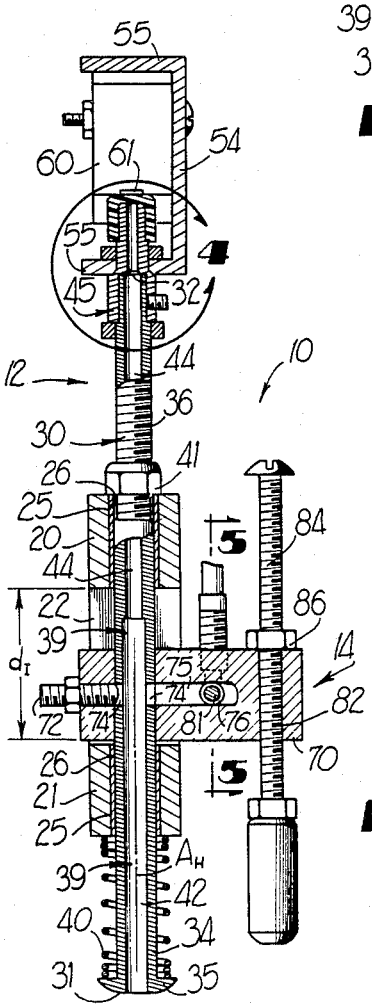
FIG. 3 is a longitudinal cross-sectional view of the inventon.

The support frame 11 includes generally an upper support bar 20 and a lower support bar 21 joined intermediate their ends by a support brace 22 so that the upper and lower support bars 20 and 21 are substantially parallel to each other but spaced apart a prescribed distance $d_1$. The support frame 11 is mounted on the shoe support $S_H$ so that the support bars 20 and 21 are oriented generally parallel to the plane of the substrate sheet SS and extend inwardly from the shoe support $S_H$ generally perpendicular to the path $P_M$ along which the substrate sheet SS is moving. The outboard ends of the upper and lower support bars 20 and 21 are connected to shoe support $S_H$ with bolts 24. The inboard ends of support bars 20 and 21 are provided with coaxially aligned holes 25 therethrough in which are fitted bearings 26 as best seen in FIG. 3. The common center line $A_H$ of the bearings 26 is generally vertically oriented with respect to the upper surface of the support plate SP in the side guide assembly SA and will thus be generally perpendicular to the plane of the substrate sheet SS.

The gauge tube assembly 12 is reciprocally mounted in the bearings 26 so that the axis of the gauge tube assembly 12 coincides with the axis $A_H$. The gauge tube assembly 12 includes a gauge tube 30 with a gauging end 31 and an upper end 32. The gauge tube 30 is sufficiently long to extend through the bearings 26 in the support frame 11 so that the lower gauging end 31 projects downwardly below the support frame 11 toward the support plate SP while the upper end 32 thereof projects above the top of the support frame 11. The gauge tube 30 has a smooth cylindrical section 34 which extends from a lower gauging flange 35 at the lower gauging end 31 of the tube 30 to a point intermediate the ends of the tube 30. An externally threaded section 36 extends from the upper end of the smooth cylindrical section 34 to a point spaced just below the upper end 32 of the tube 30.

A reduced diameter section 38 extends from the upper end of the externally threaded section 36 to the upper end 32 of the tube 30. The outside diameter of the smooth cylindrical section 34 is such that the cylindrical section 34 will be slidably supported in the bearings 26 so that the tube 30 can be reciprocated easily within the bearings 26.

Figure 6:
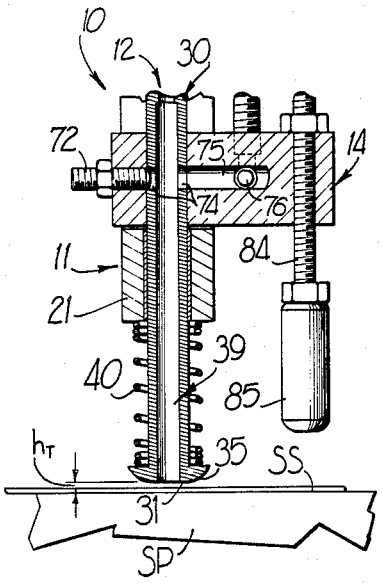
FIG. 6 is a view partly showing the invention in use during normal operation when a single sheet of substrate is passing thereby.

A compression coil spring 40 is fitted between the lower side of the lower support bar 21 and the lower gauging flange 35 so that the spring 40 urges the lower end 31 of the gauge tube 30 downwardly toward the support plate SP. An adjustment nut 41 is threadedly received on the externally threaded section 36 above the top of the upper support bar 20 so that the amount of downward movement of the tube 30 with respect to the support frame 11 is limited by the nut 41. The particular nut 41 shown in provided with an internal locking mechanism as is well known in the fastener art to keep the nut 41 locked in position after each adjustment. Thus, it will be seen that the nut 31 is used to adjust the height $h_T$ of the lower end 31 of the gauge tube 30 above the support plate SP as best seen in FIG. 6. It will also be appreciated, however, that the gauging tube 30 can be reciprocated upwardly from the position where the nut 41 engages the top of the upper support bar 20 to raise the lower end 31 of the gauge tube 30 above the support plate SP. This facilitates the movement of the substrate sheet SS under the lower end 31 of the gauge tube 30 as will become more apparent.

The gauge tube 30 defines an axially extending gauge passage 39 therethrough which opens onto both the upper end 32 and lower detecting end 31 of tube 30. The gauge passage 39 has a larger diameter section 42 along the lower portion of tube 30 and a smaller diameter section 44 along the upper portion of tube 30.

Figure 4:
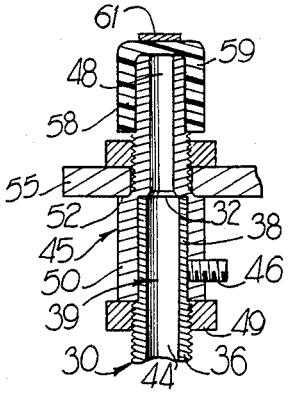
FIG. 4 is an enlarged portion of FIG. 3 taken generally along line 4.

A positioner tube 45 is mounted on the reduced diameter section 38 at the upper end of the gauge tube 30 and is selectively affixed thereto via a set screw 46. This is best seen in FIG. 4. The positioner tube 45 has a counterbore which fits over the reduced diameter section 38 and is further provided with a reduced diameter axial passage 48 which opens onto section 44 of gauging passage 39 at the upper end of the positioner tube 45. The lower end of the positioner tube 45 is positioned by a nut 49 on the threaded section 36 of tube 30. The positioner tube 45 has a cylindrical section 50 which joins with a reduced diameter threaded section 51 intermediate its ends so that a shoulder 52 is defined at the junction between cylindrical and threaded sections 50 and 51. The upper end of the positioner tube 45 is provided with a smooth cylindrical section 58 which has a diameter smaller than the crest diameter of the threaded section 51.

A support channel 54 is fitted to the positioner tube 45 through a hole in one of its legs 55 sized so that the leg 55 will be engaged by the shoulder 52. The leg 55 is captivated against the shoulder 52 by a nut 56 which locks the support channel 52 onto the positioner tube 45.

A cap member 59 is fitted over the cylindrical section 58 so that the cap member 59 slidably closes the upper end of the axial passage 48. The cap member 59 is held in place by the actuator arm 61 of a microswitch 60 mounted on the central web of channel 54. The arm 61 is spring urged with a small spring pressure toward the upper end of the positioner tube 45 so as to keep the cap member 59 closing the end of the passage 48 unless the pressure in the passage 48 rises sufficiently high to overcome the spring pressure on the actuator arm 61 and raise the cap member 59. The switch 60 is set so that, when the cap member 49 raises due to an increase in fluid pressure inside the passage 58 to raise the actuator arm 61, the switch 60 will be transferred. The output connectors 62 on the switch 60 are electrically connected to an appropriate latching relay circuit 64 schematically seen in FIG. 2 so that, when the switch 60 is transferred, circuit 64 will be actuated to operate the conventional stop feed mechanism SF on the press to prevent double feeding into the press section PS.

The drive assembly 14 is mounted on the gauge tube 30 between the upper and lower support bars 20 and 21 and is fixedly attached to the gauge tube 30 so that the drive assembly 14 can be used to reciprocally raise the gauge tube 30 with the spring 40 reciprocally lowering the tube 30. The drive assembly 14 includes a drive bar 70 provided with a passage 71 which slidably receives the cylindrical section 34 on gauge tube 30 therethrough. The drive bar 70 is affixed to the gauge tube 30 with an appropriate set screw 72. It will be appreciated that the gauge tube 30 is provided with a cross passage 74 which intersects the gauging passage 39 in the gauging tube 30. The set screw 72 engages one side of the cross passage 74 so as to both lock the drive bar 70 axially of the gauge tube 30 while at the same time orienting the drive bar 70 rotationally around the gauging tube 30.

Figure 5:
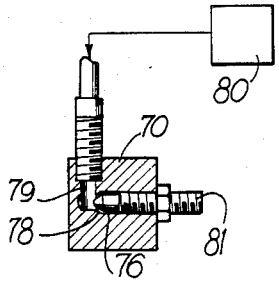
FIG. 5 is a cross-sectional view taken generally along line 5—5 in FIG. 3.

The drive bar 70 is provided with an inlet fluid passage 75 in registration with the cross passage 74 opposite the set screw 72 so that fluid introduced through the inlet passge 75 can pass into the gauging passage 39 in the gauge tube 30. The inlet fluid passage 75 intersects with a metering passage 76 provided with a seat 78 as will become more apparent so that the fluid flow through the metering passage 76 and the inlet passage 75 can be selectively controlled. The metering passage 76 connects with a supply passage 79 on the opposite side of the seat 78 from the inlet passage 75 and is connected to a pressurized fluid supply 80 schematically seen in FIG. 5. A needle valve 81 threadedly engages the drive bar 70 to be selectively positioned with respect to the seat 78 so as to regulate the flow of fluid through the metering passage 76 into the gauging passage 39 in the gauging tube 30.

The opposite end of the drive bar 70 from the gauge tube 30 is provided with an internally threaded passage 82 which threadedly receives a drive bolt 84 therein so that the drive bolt 84 is oriented generally parallel to the axis $A_H$ and spaced laterally thereof. The lower end of the drive bolt 84 is provided with a cam follower 85 and the drive bolt 84 is selectively locked with respect to the drive bar 70 by a lock nut 86. The lower end of the cam follower 85 is adapted to be engaged by the hold down shoe HS as it is reciprocated so that the lower end 31 of the gauge tube 30 will be raised as the hold down shoe HS is raised.

Figure 7:
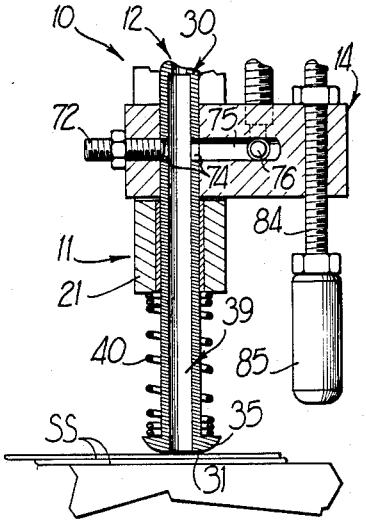
FIG. 7 is a view similar to FIG. 6 showing the invention with a double sheet of substrate passing thereby.

After the detector unit 10 is installed as illustrated in FIG. 2, the adjustment nut 41 is used to vary the height $h_T$ that the lower detecting end 31 of tube 30 is spaced above the support plate SP until the pressure in the passage 39 causes the cap member 59 to be lifted to transfer switch 60 when two substrate sheets SS are placed on the support plate SP under the tube 30 as seen in FIG. 7. At the same time, the height $h_T$ is such that an insufficient pressure will be created in passage 39 to lift the cap member 59 when only a single substrate sheet SS is present as illustrated in FIG. 6. The needle valve 81 is used to control the flow of fluid, typically air, from the pressurized fluid supply 80 in order to give the desired sensitivity to thickness of the substrate sheet SS to transfer switch 60 when a double feed is encountered, yet will not transfer switch 60 as long as a single substrate sheet SS is present. At a fluid supply pressure of about 15 psi, the detector unit 10 can be easily adjusted to detect double feeding of thin substrate sheets SS in the order of 0.002–0.003 inch.

Because the substrate sheets SS are individually moved under the lower gauging end 31 of tube 30, it is difficult to assure the passage of the substrate sheet SS thereby without the leading edge thereof sometimes catching on the tube 30. Since the hold down shoe HS is always raised while the substrate sheet SS is being fed past the side guide assembly SA and thus the detector unit 10, the drive bolt 84 is adjusted so that the cam follower 85 raises the end 31 of tube 30 when the hold down shoe HS is raised. This allows the substrate sheet SS to move under the end 31 of tube 30 without any likelihood of catching. At the same time, the drive bolt 84 is adjusted so that the cam follower 85 is released when the hold down shoe HS is fully lowered. This allows spring 40 and adjustment nut 41 to control the height $h_T$ of the end 31 of tube 30 above the support plate SP for accurate gauging. Thus, it will be seen that raising the tube 30 at the same time the hold down shoe HS is raised serves to effectively disable the detection unit 10 during the feeding of the substrate sheet into its registration position.

What is claimed as invention is:

1. A double feed detection device for detecting the feeding of multiple substrate sheets over a feed support surface to processing equipment comprising:

a support frame fixedly mounted adjacent the feed support surface;

an elongate gauge tube having opposed ends and defining an axially extending passage therethrough opening onto said opposed ends;

mounting means for reciprocally mounting said gauge tube on said support frame so that said gauge tube is oriented generally normal to the feed support surface with one of said ends thereof located a prescribed gauging distance from the feed support surface, said mounting means including stop means adjustably mounted on said gauge tube for limiting the movement of said gauge tube in said support frame toward the feed support surface and urging means for urging gauge tube toward the feed support surface so that the prescribed gauging distance can be changed by adjusting said stop means on said gauge tube;

a supply source of fluid under pressure;

connection means connecting the fluid from said supply source to said passage in said gauge tube between said opposed ends;

an indicator member closing that end of said passage in said gauge tube opposite the feed support surface and slidably movable thereon between first and second positions so that the fluid in said passage in said gauge tube urges said indicator member toward said second position;

forcing means for constantly urging said indicator member toward said first position in opposition to the fluid in said passage so that said indicator member remains in said first position until the number of substrate sheets located between said gauge tube and the feed support exceeds a prescribed quantity to cause the pressure in said gauge tube passage to rise sufficiently to force said indicator member from said first to said second position; and drive means connected to said gauge tube to selectively force said gauge tube away from the feed support surface against said urging means to increase the distance between said one of said ends of said gauge tube and the feed support surface to effectively disable the detecting capability of said device until said urging means is allowed to move said gauging tube back toward the support surface until arrested by said stop means.

2. The double feed detection device of claim 1 for use with processing equipment having feedstop means for selectively stopping the feeding of the substrate sheets to the processing equipment; said detection device further including switch means operatively associated with indicator member and adapted to be transferred when said indicator means is moved from said first position to said second position to cause said feedstop means to stop the feeding of the substrate sheets to the processing equipment.

3. The double feed detection device of claim 1 wherein said connection means includes valve means for selectively controlling the fluid flow rate between said supply source and said gauge tube passage.

4. A double feed detection device for detecting the presence of multiple substrate sheets on the feed support surface in a side guide assembly used to register the substrate sheet for feeding into processing equipment where the side guide assembly has a reciprocally mounted hold down show thereon comprising:

support frame fixedly mounted on the side guide assembly with respect to the feed support surface;

an elongate gauge tube reciprocally mounted in said support frame normal to the feed support surface for axial movement toward and away from the feed support surface, said gauge tube including a sensing end and an opposed end and defining a fluid passage therein opening onto said ends;

stop means for limiting the movement of said gauge tube toward the feed support surface;

urging means constantly urging said gauge tube toward the feed support surface;

drive means operatively connecting said gauge tube and the reciprocal hold down shoe on the side guide mechanism so that said gauging tube is moved toward the feed support table until arrested by said stop means in a gauging position with said sensing end located a prescribed distance above the feed support surface when the hold down shoe is lowered into operative position and raised out of gauging position when the hold down shoe is raised out of operative position to effectively disable the detecting capability of said device until said urging means is allowed to move said gauging tube back toward the support surface until arrested by said stop means;

an indicator member operatively associated with said opposed end of said fluid passage and forcing means for constantly urging said indicator member toward a first position, said indicator member responsive to changes in the fluid pressure in said fluid passage to be moved away from said first position and provide an indication of a change in distance between said sensing end of said gauge tube and the substrate sheets on the feed support surface while said gauge tube is lowered into gauging position.

* * * * *